US010912390B1

(12) United States Patent
Chung

(10) Patent No.: US 10,912,390 B1
(45) Date of Patent: Feb. 9, 2021

(54) EXTENDABLE MODULAR BED

(71) Applicant: ULIFE HEALTHCARE INC., Taoyuan (TW)

(72) Inventor: Ya-Hsin Chung, Taichung (TW)

(73) Assignee: ULIFE HEALTHCARE INC., Taoyuan (TW)

( * ) Notice: Subject to any disclaimer, the term of this patent is extended or adjusted under 35 U.S.C. 154(b) by 0 days.

(21) Appl. No.: 16/812,824

(22) Filed: Mar. 9, 2020

(30) Foreign Application Priority Data

Oct. 25, 2019 (TW) ..... 108214067 U

(51) Int. Cl.
*A47C 19/04* (2006.01)
*A47C 19/02* (2006.01)

(52) U.S. Cl.
CPC ..... *A47C 19/04* (2013.01); *A47C 19/025* (2013.01)

(58) Field of Classification Search
CPC ..... A47C 19/04; A47C 19/025
See application file for complete search history.

(56) References Cited

U.S. PATENT DOCUMENTS 3,898,702 A * 8/1975 Goodman ..... A61G 7/015 5/618
4,196,484 A * 4/1980 Harris ..... A47C 19/025 5/201
4,679,261 A * 7/1987 Stanley ..... A47C 19/04 403/104
4,827,543 A * 5/1989 Castiglioni ..... A47C 19/005 403/347
5,099,529 A * 3/1992 Anderson ..... A47C 19/04 5/201
5,257,428 A * 11/1993 Carroll ..... A47C 19/122 5/201
6,006,379 A * 12/1999 Hensley ..... A47C 20/041 5/616
6,101,647 A * 8/2000 Stroud ..... A47C 20/041 5/613
6,216,295 B1 * 4/2001 Pearson ..... A47C 20/041 5/613
6,276,011 B1 * 8/2001 Antinori ..... A47C 20/041 5/613
6,393,641 B1 * 5/2002 Hensley ..... A47C 20/041 5/613
6,836,912 B1 * 1/2005 Morris ..... A47C 19/04 5/181
7,448,100 B1 * 11/2008 Shih ..... A61G 7/015 5/600
2001/0000828 A1 * 5/2001 Hensley ..... A47C 20/08 5/618

(Continued)

*Primary Examiner* — Eric J Kurilla
(74) *Attorney, Agent, or Firm* — Allen, Dyer, Doppelt + Gilchrist, PA

(57) ABSTRACT

An extendable modular bed includes a frame assembly and a plurality of support units which are mounted on the frame assembly. In each of the support units, two retaining shells are detachably mounted on the frame assembly, two outer tubes are respectively and slidably retained by the retaining shells and are slidably sleeved on two end segments of an inner tube, two positioning members are respectively and detachably coupled to the retaining shells for respectively positioning the outer tube, and two spring-loaded buttons are mounted inside the inner tube to respectively extend out of two through holes of the inner tube for further positioning the outer tubes.

14 Claims, 11 Drawing Sheets

(56) References Cited

U.S. PATENT DOCUMENTS

| | | | | |
|---|---|---|---|---|
| 2006/0130236 | A1* | 6/2006 | Dewert | A47C 19/04 5/616 |
| 2008/0168602 | A1* | 7/2008 | DiForio | A47C 19/04 5/184 |
| 2009/0019640 | A1* | 1/2009 | Neuenswander | A61G 7/015 5/618 |
| 2009/0094748 | A1* | 4/2009 | Long | A47C 20/08 5/613 |
| 2009/0178201 | A1* | 7/2009 | Lujan | A47C 20/027 5/618 |
| 2009/0193587 | A1* | 8/2009 | Neuenswander | A47C 31/008 5/618 |
| 2009/0211028 | A1* | 8/2009 | Richmond | A47C 20/08 5/618 |
| 2010/0122415 | A1* | 5/2010 | Turner | A61G 7/018 5/618 |
| 2014/0250599 | A1* | 9/2014 | Cassell | A61G 7/015 5/613 |
| 2015/0121623 | A1* | 5/2015 | Huang | A61G 7/018 5/616 |
| 2016/0206111 | A1* | 7/2016 | Oh | A47C 19/02 |
| 2017/0013968 | A1* | 1/2017 | Bartelsmeyer | A47C 19/12 |
| 2018/0042389 | A1* | 2/2018 | Oh | A47C 19/04 |
| 2018/0042392 | A1* | 2/2018 | Brown | A47C 20/12 |
| 2018/0125249 | A1* | 5/2018 | Chung | A47C 19/021 |
| 2018/0125252 | A1* | 5/2018 | Chung | A47C 19/025 |
| 2020/0359803 | A1* | 11/2020 | Choi | A47C 19/04 |

* cited by examiner

EXTENDABLE MODULAR BED

CROSS-REFERENCE TO RELATED APPLICATION

This application claims priority from Taiwanese utility model patent application no. 108214067, filed on Oct. 25, 2019.

FIELD

The disclosure relates to a furniture bed, more particularly to an extendable modular bed.

BACKGROUND

Bed frames for king, queen, double and single size beds may have different widths. For bed frames of large dimensions, they are not convenient for packaging and transportation.

Chinese utility model patent no. CN207666320U discloses a conventional chair bed, in which left side plates and right side plates are hingedly connected at left and right sides of central plates and the central plates are also hingedly connected to each other. Thus, the chair bed may be transformable between a normal state and an extended state. However, transportation of the chair bed is not easy as the left and right side plates may not be detached from the central plates. In addition, the chair bed is likely to break at the junctures of the central plates and left and right side plates.

Chinese patent publication no. CN104352311A discloses a patient transfer cart.

SUMMARY

Therefore, an object of the disclosure is to provide an extendable modular bed, some elements of which may be easily detachable from each other.

According to the disclosure, an extendable modular bed includes a frame assembly and a plurality of support units which are mounted on the frame assembly, and which are displaced from each other in the longitudinal direction. Each of the support units includes two retaining shells, two positioning members, an inner tube, two outer tubes, and two spring-loaded buttons. The retaining shells are detachably mounted on the frame assembly, and are spaced apart from each other in a transverse direction relative to the longitudinal direction. The positioning members are detachably coupled to the retaining shells, respectively. The inner tube has a left end segment and a right end segment opposite to the left end segment in the transverse direction, and has two through holes respectively formed in the left and right end segments. The outer tubes are respectively slidably retained by the retaining shells, and are slidably sleeved on the left and right end segments of the inner tube, respectively, such that each of the outer tubes is slidable between a retracted position and an extended position relative to the frame assembly, and such that each of the outer tubes, when in one of the retracted and extended positions, is permitted to be positioned by a respective one of the positioning members. Each of the outer tubes has an outer engaged hole and an inner engaged hole opposite to the outer engaged hole in the transverse direction. The spring-loaded buttons are disposed inside the inner tube to respectively extend out of the through holes of the inner tube such that once each of the spring-loaded buttons is permitted to extend into one of the outer and inner engaged holes of the respective outer tube, the respective outer tube is further positioned in a respective one of the retracted position and the extended position.

BRIEF DESCRIPTION OF THE DRAWINGS

Other features and advantages of the disclosure will become apparent in the following detailed description of the embodiment (s) with reference to the accompanying drawings, in which.

DETAILED DESCRIPTION

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Figure 1:
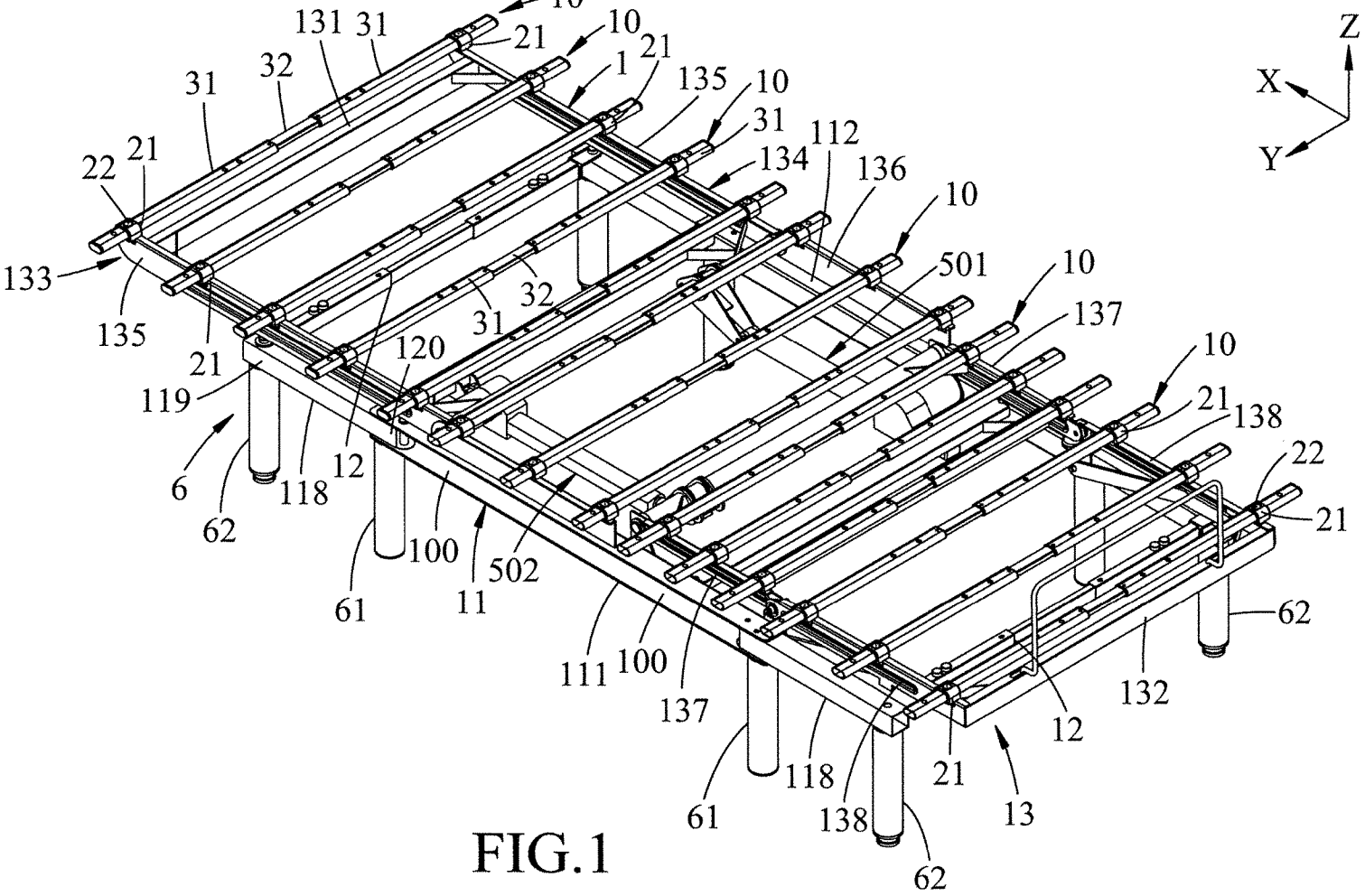
FIG. 1 is a perspective view of an extendable modular bed according to an embodiment of the disclosure, illustrating outer tubes of support units in a retracted position.
Figure 2:
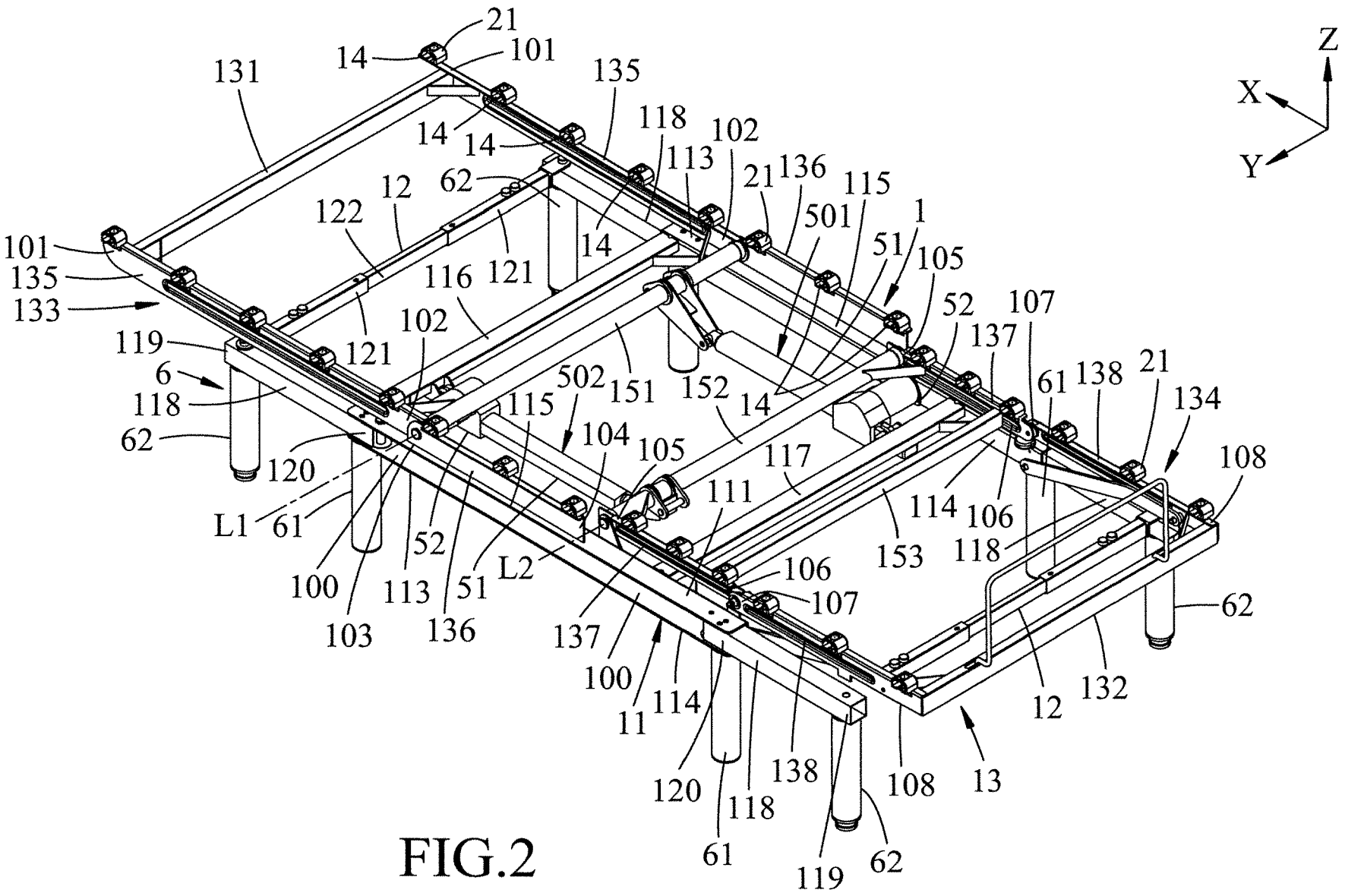
FIG. 2 is similar to FIG. 1 but omitting inner tubes and the outer tubes of the support units.
Figure 3:
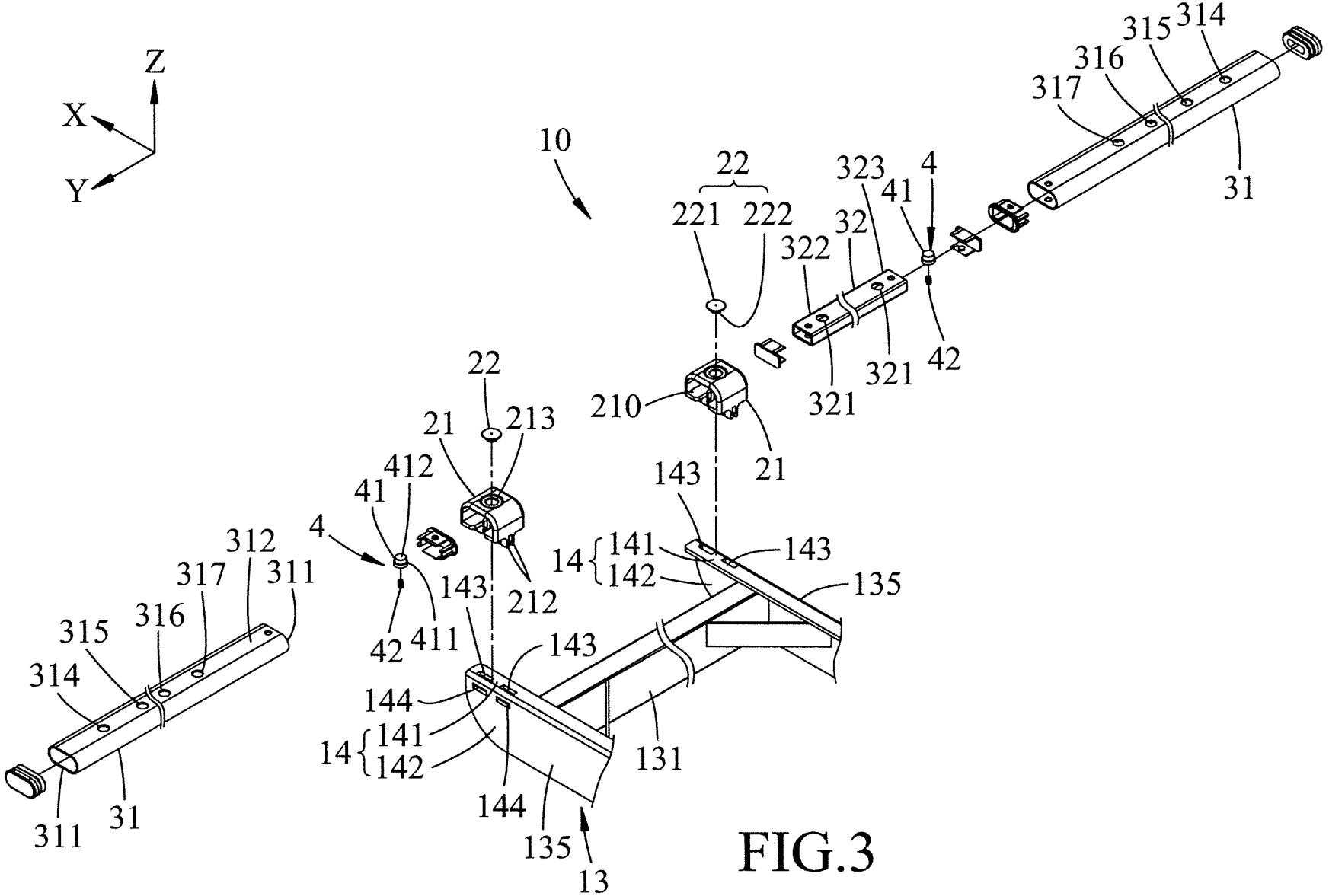
FIG. 3 is a fragmentary exploded perspective view of the extendable modular bed.
Figure 9:
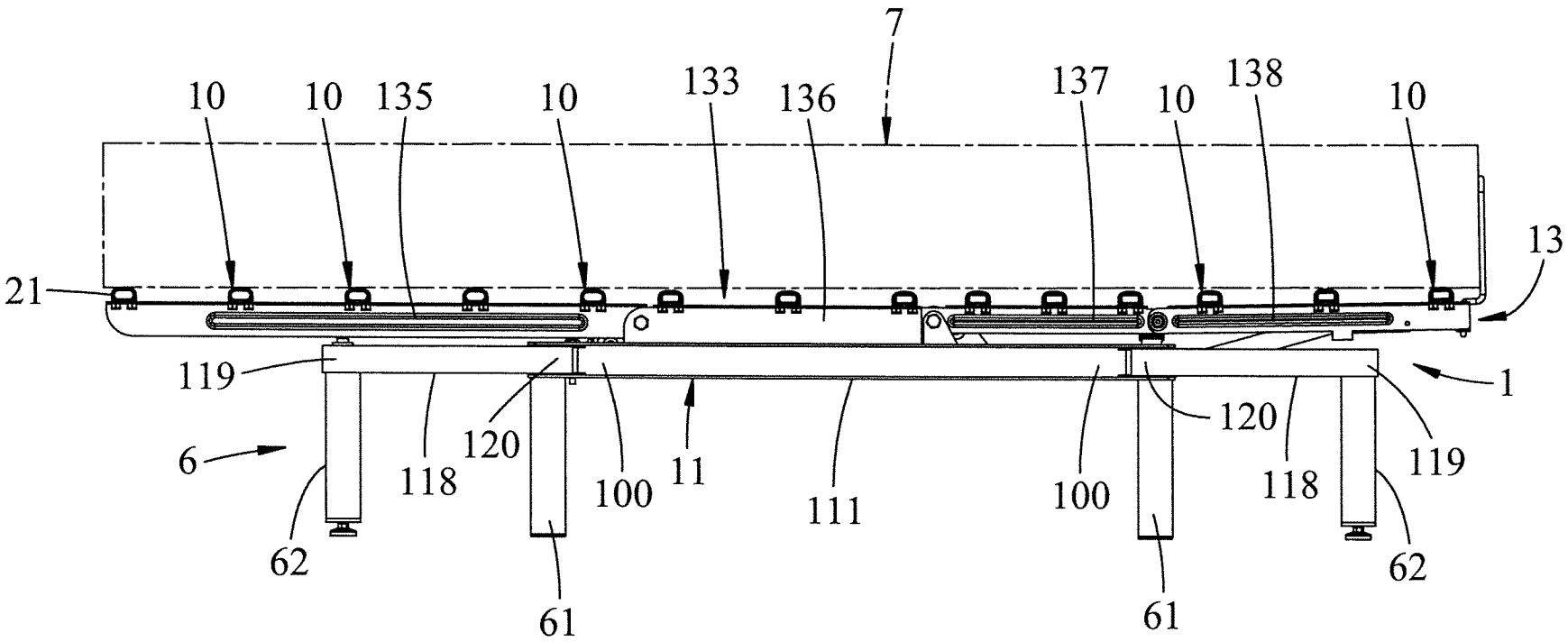
FIG. 9 is a side view of FIG. 1 illustrating linkages of the extendable modular bed in a support position.

With reference to FIGS. 1 to 3, an extendable modular bed according to an embodiment of the disclosure is shown to include a frame assembly 1 and a plurality of support units 10 which are mounted on the frame assembly 1, and which are displaced from each other in the longitudinal direction (X). As shown in FIG. 9, the support units 10 may be provided for supporting a bed mattress 7.

As shown in FIG. 3, each of the support units 10 includes two retaining shells 21, two positioning members 22, an inner tube 32, two outer tubes 31, and two spring-loaded buttons 4.

The retaining shells 21 are detachably mounted on the frame assembly 1, and are spaced apart from each other in a transverse direction (Y) relative to the longitudinal direction (X). In an embodiment shown in FIGS. 3 and 7, each of the retaining shells 21 may have a passage 210 and a socket hole 213 extending radially in an upright direction (Z) into the passage 210.

The positioning members 22 are detachably coupled to the retaining shells 21, respectively. In an embodiment shown in FIGS. 3 and 7, each of the positioning members 22 may have a plug segment 221 and a positioning segment 222 disposed beneath the plug segment 221. The plug segment 221 is configured to be brought into plug-socket connection with the socket hole 213 of the respective retaining shell 21.

As shown in FIG. 3, the inner tube 32 has a left end segment 322 and a right end segment 323 opposite to the left end segment 322 in the transverse direction (Y), and has two through holes 321 respectively formed in the left and right end segments 322, 323.

Figure 6:
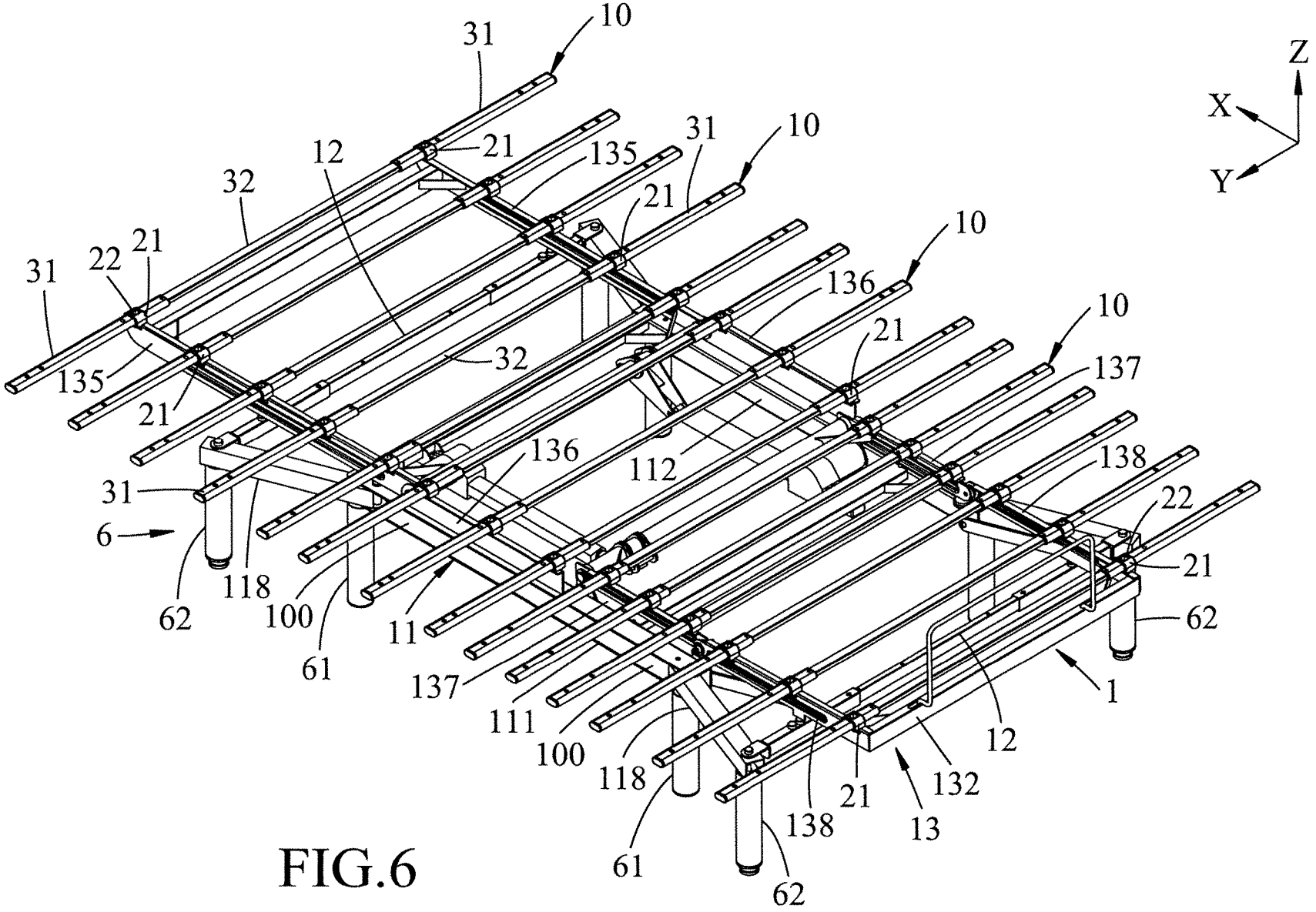
FIG. 6 is similar to FIG. 1 but illustrating the outer tubes in an extended position.

The outer tubes 31 are respectively slidably retained by the retaining shells 21, and are slidably sleeved on the left and right end segments 322, 323 of the inner tube 32, respectively. Each of the outer tubes 31 is slidable between a retracted position (FIGS. 1 and 4) and an extended position (FIGS. 6 and 8) relative to the frame assembly 1. Each of the outer tubes 31, when in one of the retracted and extended positions, is permitted to be positioned by a respective one of the positioning members 22. Furthermore, each of the outer tubes 31 has an outer engaged hole 314 and an inner engaged hole 316 opposite to the outer engaged hole 314 in the transverse direction (Y). Please note that the position of the outer tubes 31 may be adjusted based on the size of the bed mattress 7 shown in FIG. 9. When the outer tubes 31 of each of the support units 10 are close to each other in the retracted position (FIG. 1), the extendable modular bed is suitable for supporting a smaller bed mattress. When the outer tubes 31 of each of the support units 10 are remote from each other in the extended position (FIG. 6), the extendable modular bed is suitable for supporting a larger bed mattress.

Figure 7:
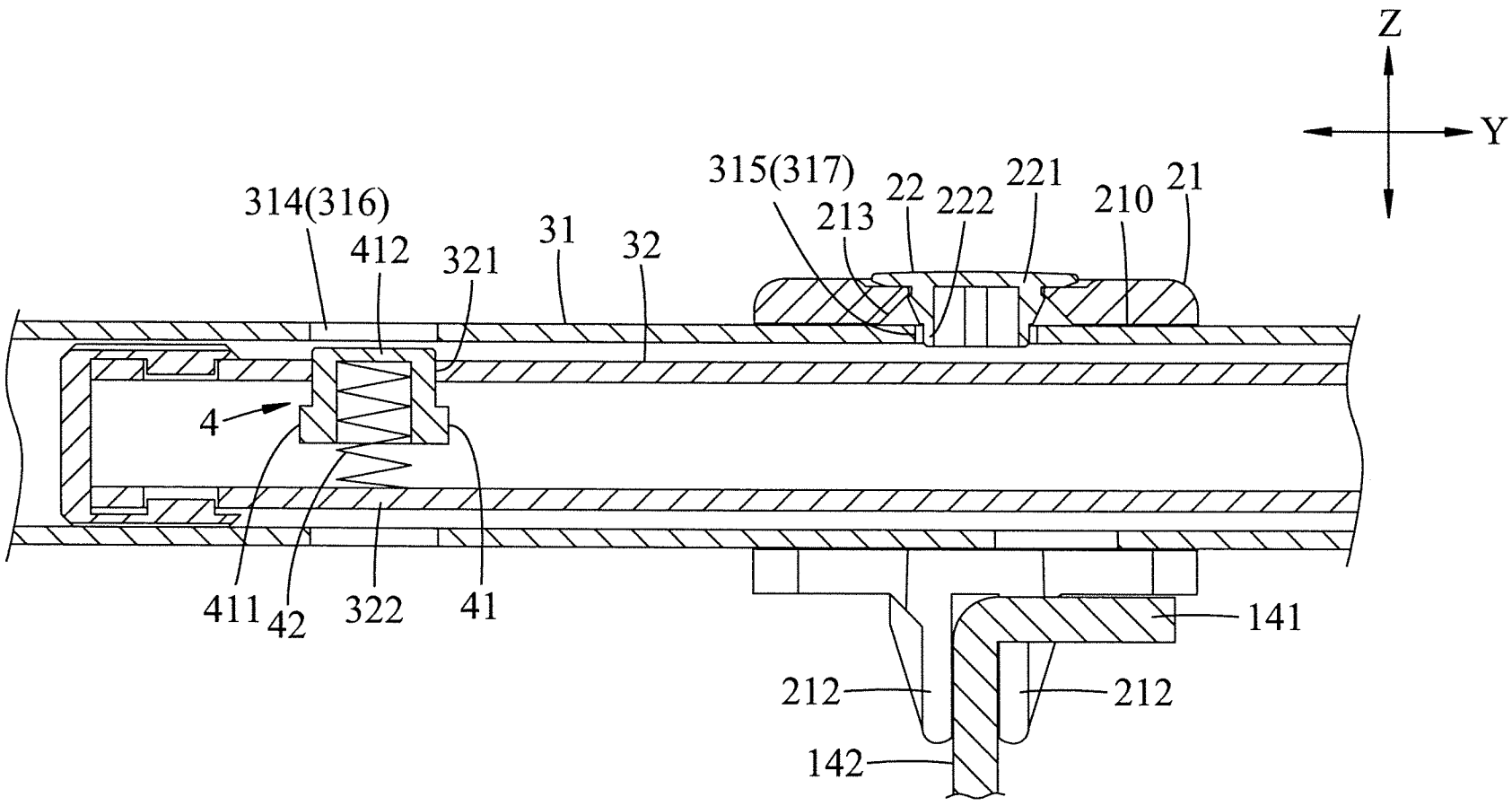
FIG. 7 is a fragmentary cross-sectional view illustrating when a spring-loaded button is pressed inwardly.

In an embodiment shown in FIGS. 3 and 7, each of the outer tubes 31 may be slidably received in the respective passage 210 to thereby be slidably retained by the respective retaining shell 21.

Figure 4:
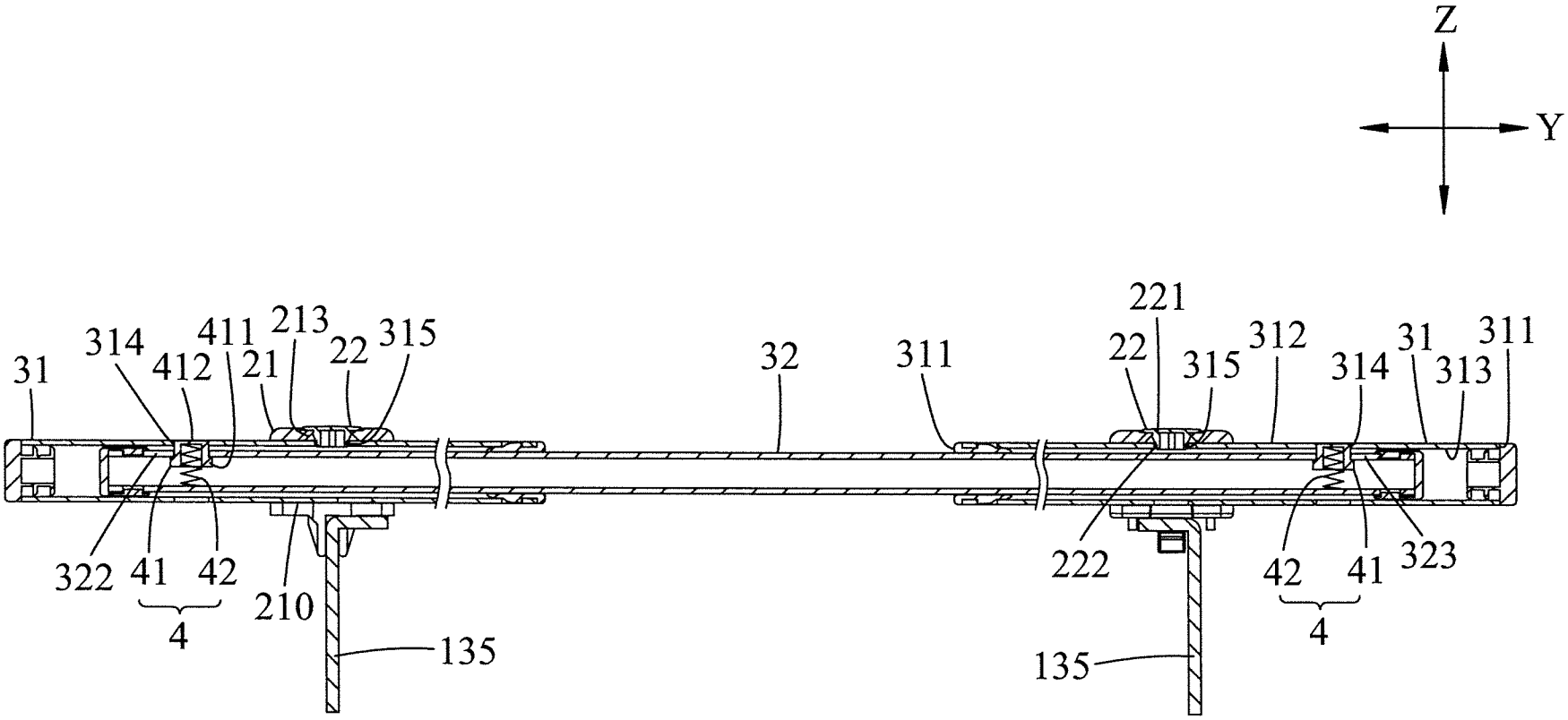
FIG. 4 is a cross-sectional view of FIG. 1.
Figure 8:
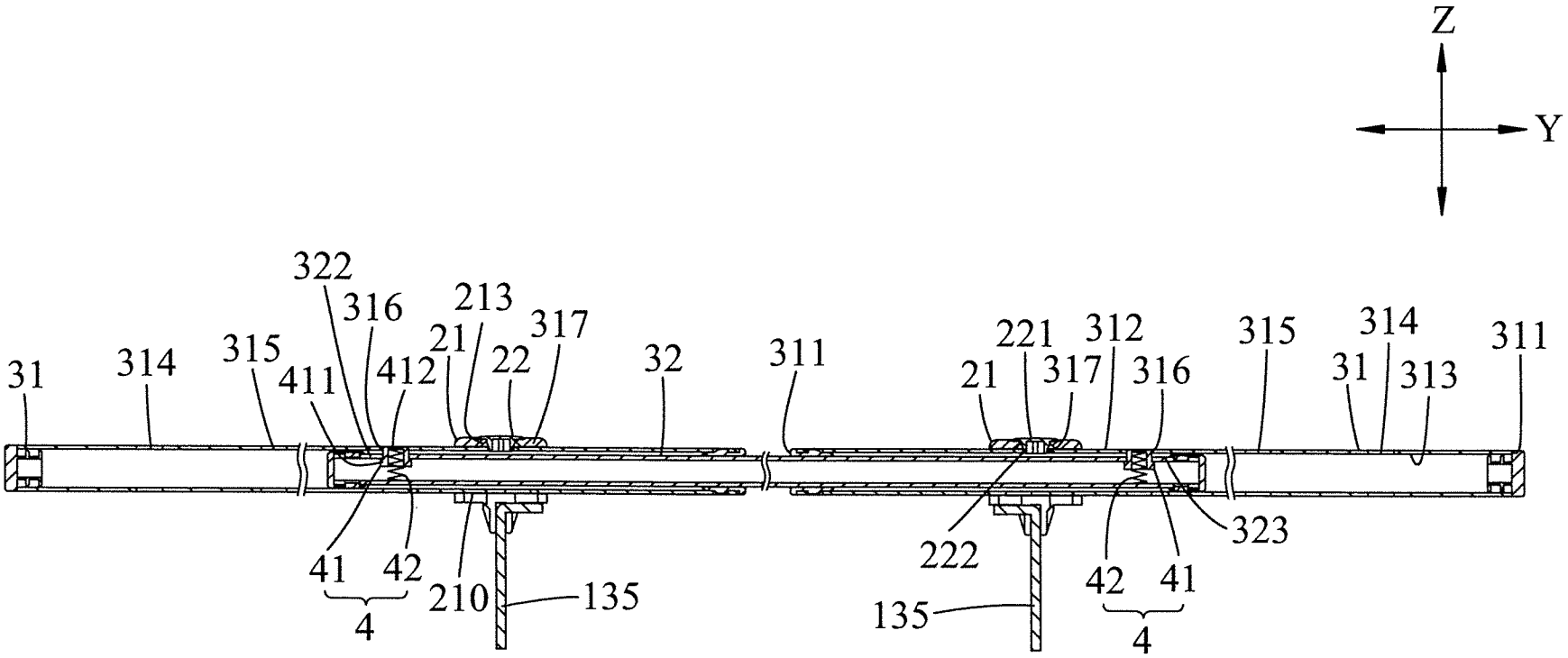
FIG. 8 is a cross-sectional view of FIG. 6.

In an embodiment shown in FIGS. 3, 4, and 8, each of the outer tubes 31 may have an outer positioned hole 315 and an inner positioned hole 317. The outer positioned hole 315 may be located inwardly of and spaced apart from the outer engaged hole 314 in the transverse direction (Y) by a predetermined distance. The inner positioned hole 317 is opposite to the outer positioned hole 315 in the transverse direction (X) and may be disposed inwardly of and spaced apart from the inner engaged hole 316 in the transverse direction (Y) by the predetermined distance. As a result of the plug-socket connection between the plug segment 221 and the socket hole 213 of the respective retaining shell 21, the positioning segment 222 is permitted to be inserted into one of the outer and inner positioned holes 315, 317 of the respective outer tube 31, thereby positioning the respective outer tube 31 in a respective one of the retracted position (FIG. 4) and the extended position (FIG. 8).

In an embodiment shown in FIGS. 3, 4, and 8, each of the outer tubes 31 extends in the transverse direction (Y) to terminate at two ends 311, and has an outer peripheral surface 312 and an inner peripheral surface 313. The outer engaged hole 314 and the outer positioned hole 315 are provided in proximity to one of the two ends 311, and the inner engaged hole 316 and the inner positioned hole 317 are provided in proximity to the other one of the two ends 311. Each of the outer and inner engaged holes 314, 316 and the outer and inner positioned holes 315, 317 extends from the outer peripheral surface 312 to the inner peripheral surface 313.

As shown in FIGS. 4 and 8, the spring-loaded buttons 4 are disposed inside the inner tube 32 to respectively extend out of the through holes 321 of the inner tube 32 such that once each of the spring-loaded buttons 4 is permitted to extend into one of the outer and inner engaged holes 314, 316 of the respective outer tube 31, the respective outer tube 31 is further positioned in the respective one of the retracted position (FIG. 4) and the extended position (FIG. 8).

In an embodiment shown in FIGS. 3, 4, and 7, each of the spring-loaded buttons 4 may include a button cap 41 and a spring 42. The button cap 41 has an upper closed end 412 and a lower open end which is opposite to the upper closed end 412 in the upright direction (Z) and which is formed with a flange 411. The spring 42 is disposed between an inner peripheral surface of the inner tube 32 and the button cap 41 to bias the upper closed end 412 to extend out of the respective through hole 321 while the flange 411 of the spring-loaded button 4 is retained inside the inner tube 32. When the upper closed end 412 in the outer or inner engaged hole 314, 316 of the respective outer tube 31 is pressed inwardly (see FIG. 7), the respective outer tube 31 is permitted to slide relative to the inner tube 32 after removal of the corresponding positioning member 22.

As shown in FIG. 2, the frame assembly 1 may include a support frame 13 having a front bar 131, a rear bar 132, a left bar unit 133, and a right bar unit 134. Each of the front and rear bars 131, 132 extends in the transverse direction (Y) to terminate at a left bar end and a right bar end. The left bar unit 133 extends in the longitudinal direction (X) to interconnect the left bar ends of the front and rear bars 131, 132. The right bar unit 134 extends in the longitudinal direction (X) to interconnect the right bar ends of the front and rear bars 131, 132. The retaining shells 21 of each of the support units 10 are detachably and respectively mounted to the left and right bar units 133, 134 such that the support units 10 are mounted on the left and right bar units 133, 134 to be displaced from each other in the longitudinal direction (X).

Figure 5:
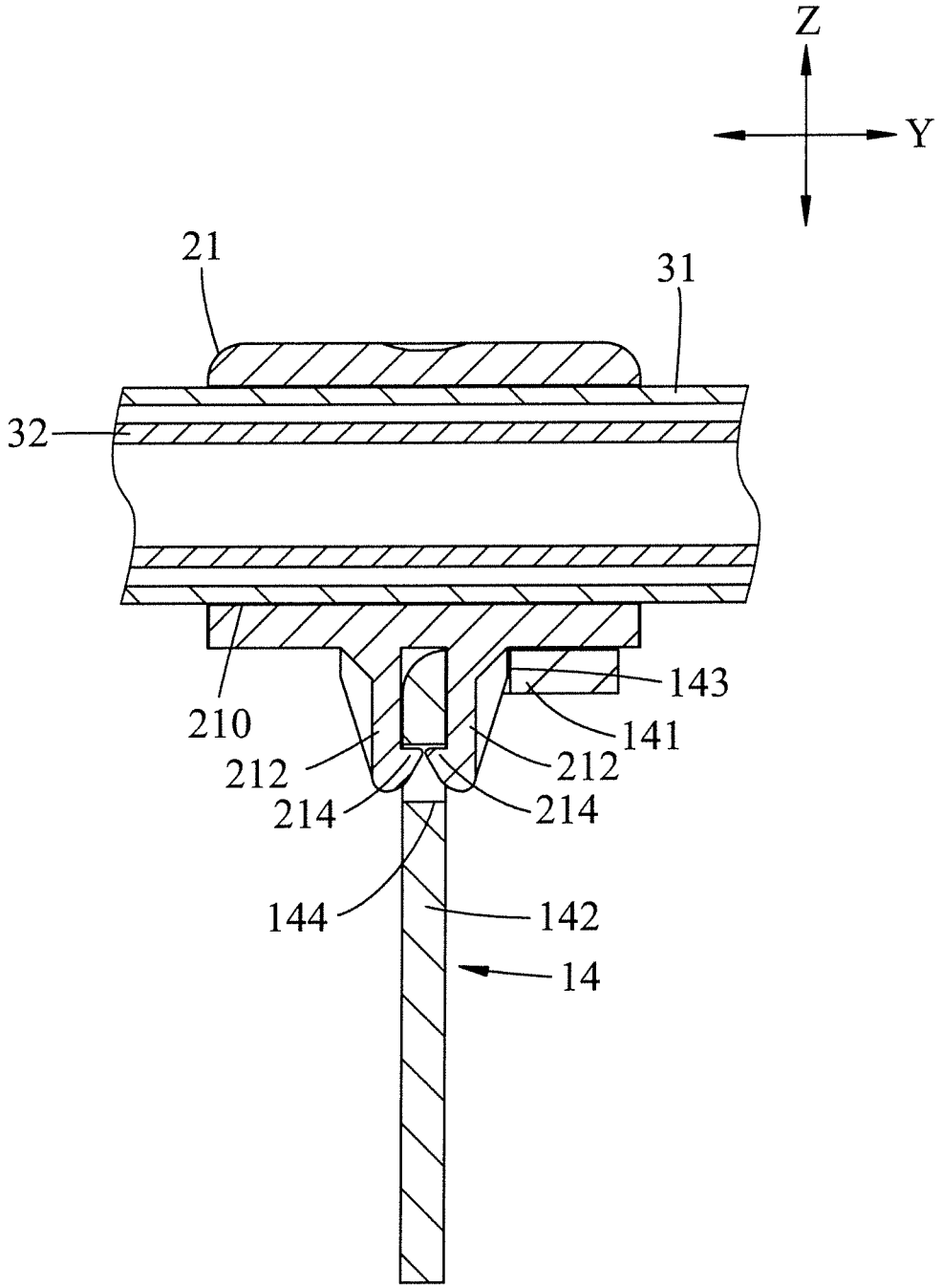
FIG. 5 is an enlarged fragmentary cross-sectional view illustrating how two anchors of a retaining shell are anchored to a support frame of the extendable modular bed.

In an embodiment shown in FIGS. 2, 3, and 5, each of the left and right bar units 133, 134 has a plurality of mounting regions 14 displaced from each other in the longitudinal direction (X). The retaining shells 21 of each of the support units 10 are mounted respectively to two corresponding mounting regions 14 of the left and right bar units 133, 134.

In an embodiment shown in FIGS. 2, 3, and 5, each of the mounting regions 14 may have a horizontal wall area 141 which has an upper hole 143, and a vertical wall area 142 which extends downwardly from an edge of the horizontal wall area 141 and which has a lateral hole 144. Each of the retaining shells 21 may have at least one pair of anchors 212 mounted therebeneath. The anchors 212 are spaced apart from each other in the transverse direction (Y), and have two anchor ends 214, respectively. Each of the anchors 212 extend in the upright direction (Z). When one of the anchors 212 extends through the upper hole 143 of the corresponding mounting region 14, the anchor ends 214 of the two anchors 212 are permitted to anchor in the lateral hole 144 of the corresponding mounting region 14 from two opposite sides of the corresponding vertical wall area 142, thereby mounting the corresponding retaining shell 21 to the corresponding mounting region 14.

In an embodiment shown in FIG. 3, in each of the mounting regions 14, the horizontal wall area 141 has two of the upper holes 143 which are spaced apart in the longitudinal direction (X), and the vertical wall area 142 has two of the lateral holes 144 which are spaced apart in the longitudinal direction (X) in positions corresponding to the upper holes 143. Furthermore, two pairs of the anchors 212 (only one pair is shown) are mounted beneath each of the retaining shells 21, and are spaced apart from each other in the longitudinal direction (X).

In an embodiment shown in FIGS. 1 and 2, the frame assembly 1 may further include a base frame 11 configured to support the support frame 13 thereon and having a left beam 111, a right beam 112, a front beam 116, and a rear beam 117. The left and right beams 111, 112 are spaced apart from each other in the transverse direction (Y), and each of the left and right beams 111, 112 has a front end segment 113, a rear end segment 114 opposite to the front end segment 113, and a middle segment 115 between the front and rear end segments 113, 114. The front beam 116 extends in the transverse direction (Y) to interconnect the front end segments 113 of the left and right beams 111, 112. The rear beam 117 extends in the transverse direction (Y) to interconnect the rear end segments 114 of the left and right beams 111, 112.

In an embodiment shown in FIG. 2, each of the left and right bar units 133, 134 may include a first bar 135, a second bar 136, a third bar 137, and a fourth bar 138. The first bar 135 has a first rear end 102 and a first front end 101 which is secured to a respective one of the left and right bar ends of the front bar 131. The second bar 136 is disposed rearwardly of the first bar 135 and is mounted on the middle segment 115 of a respective one of the left and right beams 111, 112. The second bar 136 has a second rear end 104 and a second front end 103. The first rear end 102 is pivotally connected relative to the second front end 103 about a first axis (L1) in the transverse direction (Y). In an embodiment shown in FIG. 2, the first rear end 102 is pivotally connected to the second front end 103. Otherwise, the first rear end 102 may be pivotally connected on the front end segment 113 of the respective one of the left and right beams 111, 112. The third bar 137 is disposed rearwardly of the second bar 136, and has a third rear end 106 and a third front end 105 which is pivotally connected to the middle segment 115 of the respective one of the left and right beams 111, 112 about a second axis (L2) in the transverse direction (Y). The fourth bar 138 has a fourth rear end 108 which is secured to a respective one of the left and right bar ends of the rear bar 132, and a fourth front end 107 which is pivotally connected to the third rear end 106.

In an embodiment shown in FIG. 2, the support frame 13 may further include a first middle bar 151, a second middle bar 152, and a third middle bar 153. The first middle bar 151 interconnects the first rear ends 102 of the first bars 135 of the left and right bar units 133, 134 so as to permit the first bars 135 of the left and right bar units 133, 134 to turn together relative to the base frame 11, thereby allowing turning of the front bar 131 about the first axis (L1). The second middle bar 152 interconnects the third front ends 105 of the third bars 137 of the left and right bar units 133, 134 so as to permit the third bars 137 to turn together relative to the base frame 11. The third middle bar 153 interconnects the third rear ends 106 of the third bars 137 of the left and right bar units 133, 134 so as to permit the third middle bar 153 to turn with the second middle bar 152 about the second axis (L2).

In an embodiment shown in FIGS. 1, 2, 6, 11, the extendable modular bed may further include a first jack member 501 and a second jack member 502. The first jack member 501 is coupled between the first middle bar 151 and the rear beam 117 so as to permit the front bar 131 to be driven by the first jack member 501 to be liftable about the first axis (L1) from a head normal position (FIGS. 1, 2, and 6), where the front bar 131 is close to the ground, to a head elevated position (FIG. 11), where the front bar 131 is remote from the ground. The second jack member 502 is coupled between the second middle bar 152 and the front beam 116 so as to permit the third middle bar 153 to be driven by the second jack member 502 to be liftable about the second axis (L2) from a leg normal position (FIGS. 1, 2, and 6), where the third middle bar 153 is close to the ground, to a leg elevated position (FIG. 11), where the third middle bar 153 is remote from the ground. Each of the first and second jack members 501, 502 may include a jack body 51 driven by a motor 502.

Figure 10:
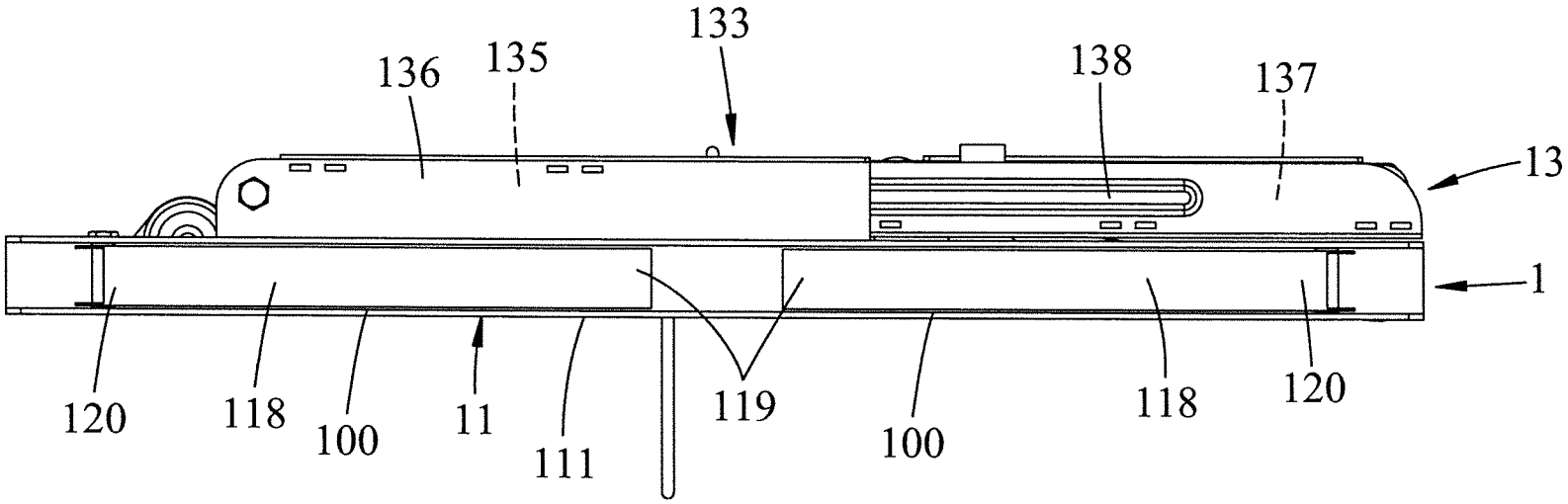
FIG. 10 is a side view illustrating the linkages in a received position.
Figure 11:
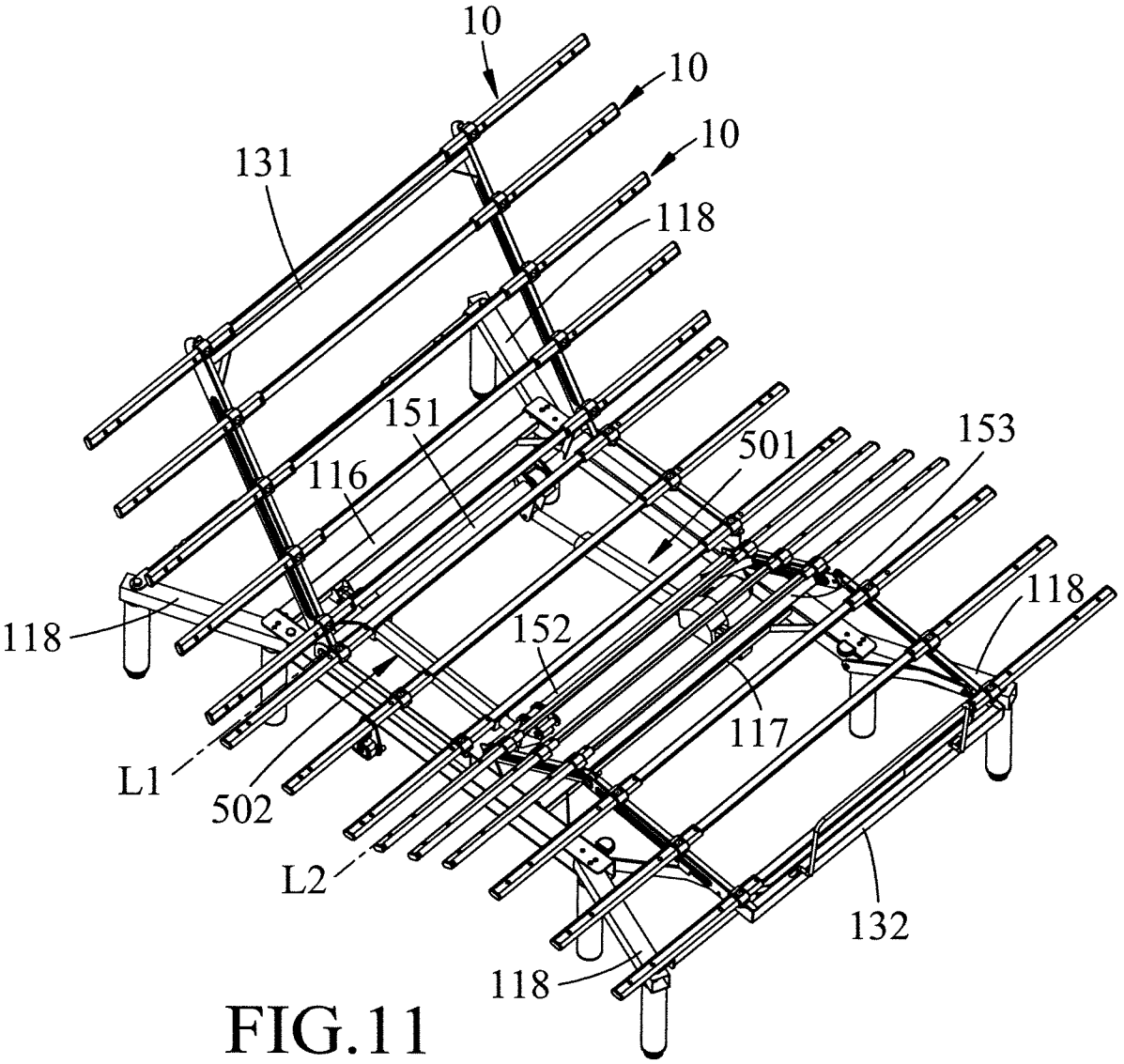
FIG. 11 is similar to FIG. 6 but illustrating a front bar in a head elevated position and a third middle bar in a leg elevated position.

In an embodiment shown in FIGS. 1, 2, 9, and 10, each of the front and rear end segments 113, 114 of at least one of the left and right beams 111, 112 may be formed with an open groove 100 which faces outwardly. The frame assembly 1 may further include at least two linkages 118 each including a support end 119 and a pivot end 120 which is opposite to the support end 119, and which is pivotally mounted in a respective one of the open grooves 100 of the at least one of the left and right beams 111, 112. Each of the linkages 118 is movable between a received position and a supporting position. In the received position, as shown in FIG. 10, the support end 119 is received in the corresponding open groove 100. In the supporting position, as shown in FIGS. 1, 2, and 9, the support end 119 is disposed outwardly of the corresponding open groove 100.

In an embodiment shown in FIGS. 1, 2, 9, and 10, each of the front and rear end segments 113, 114 of each of the left and right beams 111, 112 may be formed with the open groove 100, and the base frame 11 may include four of the linkages 118. The pivot end 120 of each of the linkages 118 is pivotally mounted in a respective one of the open grooves 100 of the front and rear end segments 113, 114 of the left and right beams 111, 112.

Please note that when the outer tubes 31 of the support units 10 are in the retracted position (FIG. 1), each linkage 118 in the supporting position may define a first included angle of 180° together with the corresponding one of left and right beams 111, 112. When the outer tubes 31 of the support units 10 are in the extended position (FIG. 6), each linkage 118 in the supporting position may define a second included angle together with the corresponding one of left and right beams 111, 112. The second included angle is smaller than the first included angle. The included angle between each linkage 118 and the corresponding one of left and right beams 111, 112 may range from 0° to 180°.

In an embodiment shown in FIGS. 1 and 2, the extendable modular bed may further include a leg assembly 6 configured to elevate and place the frame assembly 1 in a stationary state. The leg assembly 6 may include a plurality of first legs 61 which are detachably mounted beneath the base frame 11, and a plurality of second legs 62 which are detachably and respectively mounted beneath the support ends 119 of the linkages 118 when the support ends 119 of the linkages 118 are in the supporting position.

In an embodiment shown in FIGS. 1 and 2, the frame assembly 1 further includes two telescopic rods 12 each of which extends in the transverse direction (Y), and each of which is detachably connected between the support ends 119 of two front or rear ones of linkages 118 when the support ends 119 of the linkages 118 are in the supporting position.

In an embodiment shown in FIG. 2, each of the telescopic rods 12 may include an inner rod 122 which has two rod end segments, and two outer hollow rods 121 which are slidably and respectively sleeved on the rod end segments of the inner rod 122, and which respectively have two outer ends that are detachably connected between the support ends 119 of two front or rear ones of linkages 118, respectively. When the included angle between each linkage 118 and the corresponding one of left and right beams 111, 112 is greater than 90°, each of the telescopic rods 12 may be adjusted in length so as to connect the support ends 119 of two front or rear ones of linkages 118.

Please note that because the weight of a user may be evenly distributed to the base frame 11 through the inner and outer tubes 32, 31 of the support units 101, the extendable modular bed is less likely to be damaged when in use.

Furthermore, after detaching the positioning members 21 of each support unit 10 from the retaining shells 21, the inner and outer tubes 32, 31 of the corresponding support unit 10 may be removed from the support frame 13. Next, the retaining shells 22 and the leg assembly 6 may be detached from the frame assembly 1. Thereafter, as shown in FIG. 10, the first bar 135 of each of the left and right bar units 133, 134 (only the left bar unit 133 shown in FIG. 10) may be folded rearwardly on the base frame 11, the first bar 138 of each of the left and right bar units 133, 134 may be folded forwardly on the base frame 11, and each linkage 118 may be received in the corresponding open groove 100 of the base frame 11. As a result, the extendable modular bed may greatly reduce in volume and is more convenient for storage or transportation.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. An extendable modular bed comprising a frame assembly and a plurality of support units which are mounted on said frame assembly, and which are displaced from each other in the longitudinal direction, each of said support units including two retaining shells detachably mounted on said frame assembly, and spaced apart from each other in a transverse direction relative to the longitudinal direction;

two positioning members detachably coupled to said retaining shells, respectively;

an inner tube which has a left end segment and a right end segment opposite to the left end segment in the transverse direction, and which has two through holes respectively formed in said left and right end segments;

two outer tubes which are respectively slidably retained by said retaining shells, and which are slidably sleeved on said left and right end segments of said inner tube, respectively, such that each of said outer tubes is slidable between a retracted position and an extended position relative to said frame assembly, and such that each of said outer tubes, when in one of the retracted and extended positions, is permitted to be positioned by a respective one of said positioning members, each of said outer tubes having an outer engaged hole and an inner engaged hole opposite to said outer engaged hole in the transverse direction; and two spring-loaded buttons disposed inside said inner tube to respectively extend out of said through holes of said inner tube such that once each of said spring-loaded buttons is permitted to extend into one of said outer and inner engaged holes of said respective outer tube, said respective outer tube is further positioned in a respective one of the retracted position and the extended position.

2. The extendable modular bed according to claim 1, wherein each of said retaining shells has a passage such that each of said outer tubes is slidably received in said respective passage to thereby be slidably retained by said respective retaining shell.

3. The extendable modular bed according to claim 2, wherein each of said retaining shells further has a socket hole extending radially into said passage;

wherein each of said outer tubes has an outer positioned hole spaced apart from said outer engaged hole in the transverse direction by a predetermined distance, and an inner positioned hole which is opposite to said outer positioned hole in the transverse direction and which is spaced apart from said inner engaged hole in the transverse direction by the predetermined distance; and wherein each of said positioning members has a plug segment and a positioning segment disposed beneath said plug segment such that as a result of a plug-socket connection between said plug segment and said socket hole of said respective retaining shell, said positioning segment is permitted to be inserted into one of said outer and inner positioned holes of said respective outer tube, thereby positioning said respective outer tube in a respective one of the retracted and extended positions.

4. The extendable modular bed according to claim 1, wherein said frame assembly includes a support frame having a front bar which extends in the transverse direction to terminate at a left bar end and a right bar end, a rear bar which extends in the transverse direction to terminate at a left bar end and a right bar end, a left bar unit which extends in the longitudinal direction to interconnect said left bar ends of said front and rear bars, and a right bar unit which extends in the longitudinal direction to interconnect said right bar ends of said front and rear bars; and wherein said retaining shells of each of said support units are detachably and respectively mounted to said left and right bar units such that said support units are mounted on said left and right bar units to be displaced from each other in the longitudinal direction.

5. The extendable modular bed according to claim 4, wherein each of said left and right bar units has a plurality of mounting regions displaced from each other in the longitudinal direction; and wherein said retaining shells of each of said support units are mounted respectively to two corresponding mounting regions of said left and right bar units.

6. The extendable modular bed according to claim 5, wherein each of said mounting regions has a horizontal wall area which has an upper hole, and a vertical wall area which extends downwardly from an edge of said horizontal wall area and which has a lateral hole; and wherein each of said retaining shells has at least two anchors mounted therebeneath, said anchors being spaced apart from each other in the transverse direction, and having two anchor ends, respectively, such that when one of said anchors extends through said upper hole of said corresponding mounting region, said anchor ends of said two anchors are permitted to anchor in said lateral hole of said corresponding mounting region from two opposite sides of said corresponding vertical wall area, thereby mounting said corresponding retaining shell to said corresponding mounting region.

7. The extendable modular bed according to claim 5, wherein said frame assembly further includes a base frame configured to support said support frame thereon and having a left beam and a right beam, which are spaced apart from each other in the transverse direction, each of said left and right beams having a front end segment, a rear end segment opposite to said front end segment, and a middle segment between said front and rear end segments, a front beam extending in the transverse direction to interconnect said front end segments of said left and right beams, and a rear beam which extends in the transverse direction to interconnect said rear end segments of said left and right beams.

8. The extendable modular bed according to claim 7, wherein each of said left and right bar units includes a first bar having a first rear end and a first front end which is secured to a respective one of said left and right bar ends of said front bar, a second bar disposed rearwardly of said first bar and mounted on said middle segment of a respective one of said left and right beams, said second bar having a second rear end and a second front end, said first rear end being pivotally connected relative to said second front end about a first axis in the transverse direction, a third bar disposed rearwardly of said second bar, and having a third rear end and a third front end which is pivotally connected to said middle segment of the respective one of said left and right beams about a second axis in the transverse direction, and a fourth bar having a fourth rear end which is secured to a respective one of said left and right bar ends of said rear bar, and a fourth front end which is pivotally connected to said third rear end.

9. The extendable modular bed according to claim 8, wherein said support frame further includes a first middle bar interconnecting said first rear ends of said first bars of said left and right bar units so as to permit said first bars of said left and right bar units to turn together relative to said base frame, thereby allowing turning of said front bar about the first axis, a second middle bar interconnecting said third front ends of said third bars of said left and right bar units so as to permit said third bars to turn together relative to said base frame, and a third middle bar interconnecting said third rear ends of said third bars of said left and right bar units so as to permit said third middle bar to turn with said second middle bar about the second axis.

10. The extendable modular bed according to claim 9, further comprising:

a first jack member coupled between said first middle bar and said rear beam so as to permit said front bar to be drive by said first jack member to be liftable about the first axis from a head normal position, where said front bar is close to the ground, to a head elevated position, where said front bar is remote from the ground; and a second jack member coupled between said second middle bar and said front beam so as to permit said third middle bar to be driven by said second jack member to be liftable about the second axis from a leg normal position, where said third middle bar is close to the ground, to a leg elevated position, where said third middle bar is remote from the ground.

11. The extendable modular bed according to claim 7, wherein each of said front and rear end segments of at least one of said left and right beams is formed with an open groove that faces outwardly; and wherein said frame assembly further includes at least two linkages each including a support end and a pivot end which is opposite to said support end, and which is pivotally mounted in a respective one of said open grooves of said at least one of said left and right beams, each of said linkages being movable between a received position, where said support end is received in said corresponding open groove, and a supporting position, where said support end is disposed outwardly of said corresponding open groove.

12. The extendable modular bed according to claim 11, wherein each of said front and rear end segments of each of said left and right beams is formed with said open groove; and wherein said base frame includes four of said linkages, said pivot end of each of said linkages being pivotally mounted in a respective one of said open grooves of said front and rear end segments of said left and right beams.

13. The extendable modular bed according to claim 12, further comprising a leg assembly configured to elevate and place said frame assembly in a stationary state, and including a plurality of first legs which are detachably mounted beneath said base frame, and a plurality of second legs which are detachably and respectively mounted beneath said support ends of said linkages when said support ends of said linkages are in the supporting position.

14. The extendable modular bed according to claim 12, wherein said frame assembly further includes two telescopic rods each of which extends in the transverse direction, and each of which is detachably connected between said support ends of two front or rear ones of linkages when said support ends of said linkages are in the supporting position.

* * * * *